US007591397B2

(12) United States Patent
Leonetti

(10) Patent No.: US 7,591,397 B2
(45) Date of Patent: Sep. 22, 2009

(54) AUTOMATIC DISPENSING MACHINE FOR VOLUMINOUS AND/OR HEAVY PRODUCTS AND/OR PRODUCTS SOLD IN PACKS

(75) Inventor: Philippe Leonetti, Rambervillers (FR)

(73) Assignee: Staake Investment & Consulting GmbH & Co. KG, Braunschweig (DE)

( * ) Notice: Subject to any disclaimer, the term of this patent is extended or adjusted under 35 U.S.C. 154(b) by 258 days.

(21) Appl. No.: 10/591,105

(22) PCT Filed: Feb. 24, 2005

(86) PCT No.: PCT/IB2005/000464

§ 371 (c)(1),
(2), (4) Date: Nov. 17, 2006

(87) PCT Pub. No.: WO2005/093673

PCT Pub. Date: Oct. 6, 2005

(65) Prior Publication Data

US 2008/0223871 A1 Sep. 18, 2008

(30) Foreign Application Priority Data

Mar. 1, 2004 (FR) ..... 04 02074
Jul. 1, 2004 (FR) ..... 04 07298

(51) Int. Cl.
*G07F 11/16* (2006.01)

(52) U.S. Cl. ..... 221/133; 221/74; 221/279

(58) Field of Classification Search ..... 221/1, 221/2, 4–10, 12–14, 16, 18, 20, 29, 31, 52, 221/74, 78, 79, 83, 85, 87, 90, 95, 96, 121, 221/123, 129, 131, 133, 143, 147, 150 R–153, 221/166, 178, 187, 191, 192, 195, 205, 208, 221/216, 218, 221, 226, 227, 233, 239, 247–250, 221/253, 257, 258, 261, 270, 279
See application file for complete search history.

(56) References Cited

U.S. PATENT DOCUMENTS 1,633,675 A * 6/1927 Oliver ..... 194/296

(Continued)

FOREIGN PATENT DOCUMENTS

DE 33 01 905 7/1984

(Continued)

*Primary Examiner*—Gene Crawford
*Assistant Examiner*—Kelvin L Randall, Jr.
(74) *Attorney, Agent, or Firm*—Davis & Bujold, P.L.L.C.

(57) ABSTRACT

The invention concerns a reliable, simple, economical and ergonomic dispensing machine requiring little maintenance, for example of bottled mineral water sold in pack or carboy, enabling a novel dispensing circuit to be set up which combines the practical aspect for the consumer by being closer to his residence with the ecological aspect for centralized recycling of empty packs, while promoting sales for water producers. The automatic dispensing machine (1) consists of a box (10) comprising payment mechanisms (21) and/or mechanisms (22) for selecting products (2), a multistage unit for storing (30) products (2) provided with mechanisms for pushing forward (40) the selected product towards a transfer zone (50), transfer mechanism (51) mobile inside the transfer zone (50) for seizing the product (2) from the storage unit (30), separating same from other stored products (2) by tilting same by a few degrees and brining same opposite an outlet (60) closed by at least one trap-door (61) coupled with actuating mechanism (65), thrusting mechanisms (70) for delivering the product (2) outside the box (10), a recycling container (80) adjacent the box (10) provided with an inlet (81) closed by a controlled access trap-door (82) and mechanism for monitoring the whole assembly. The invention is useful for automatic dispensing of consumer products.

28 Claims, 8 Drawing Sheets

U.S. PATENT DOCUMENTS

| | | | | | |
|---|---|---|---|---|---|
| 2,531,347 | A | * | 11/1950 | Voigtritter | 221/108 |
| 2,590,736 | A | * | 3/1952 | Tandler et al. | 194/244 |
| 2,884,163 | A | * | 4/1959 | Du Grenier et al. | 221/90 |
| 3,001,669 | A | * | 9/1961 | Tandler et al. | 221/12 |
| 3,064,856 | A | * | 11/1962 | Council | 221/13 |
| 3,126,124 | A | * | 3/1964 | Katz et al. | 221/90 |
| 3,158,247 | A | * | 11/1964 | Gale | 194/201 |
| 3,194,431 | A | * | 7/1965 | Garvin | 221/19 |
| 4,000,821 | A | * | 1/1977 | Naito et al. | 414/797.6 |
| 4,108,333 | A | * | 8/1978 | Falk et al. | 221/13 |
| 4,245,731 | A | * | 1/1981 | Herbst et al. | 194/209 |
| 6,230,930 | B1 | * | 5/2001 | Sorensen et al. | 221/131 |
| 6,604,652 | B1 | * | 8/2003 | Trautwein | 221/124 |
| 6,962,267 | B2 | * | 11/2005 | Herzog et al. | 221/85 |
| 2001/0000609 | A1 | * | 5/2001 | Rudick et al. | 221/6 |
| 2003/0178435 | A1 | * | 9/2003 | Yamaguchi | 221/2 |
| 2004/0140317 | A1 | * | 7/2004 | Forte | 221/123 |

FOREIGN PATENT DOCUMENTS

| | | |
|---|---|---|
| EP | 0 590 646 | 4/1994 |
| EP | 0 866 460 | 9/1998 |
| EP | 1 253 562 | 10/2002 |
| FR | 2 839 958 | 11/2003 |
| WO | WO 94/25942 | 11/1994 |
| WO | WO 00/41144 | 7/2000 |
| WO | WO 01/24125 | 4/2001 |

* cited by examiner

AUTOMATIC DISPENSING MACHINE FOR VOLUMINOUS AND/OR HEAVY PRODUCTS AND/OR PRODUCTS SOLD IN PACKS

This application is a national stage filing of PCT/IB2005/000464 filed Feb. 24, 2005 which claims priority from French Application Serial No. 04/07298 filed July Mar. 1, 2004 and French Application Serial No. 04/02074 filed Mar. 1, 2004.

FIELD OF THE INVENTION

The present invention concerns an apparatus for the automatic dispensing of voluminous and/or heavy products and/or products sold in packs.

PRIOR ART

Apparatus for automatically dispensing beverages and/or food products are very common. They dispense beverages or food products by the unit, each unit being fairly small in size so it can easily be transported and manipulated inside the device.

The example given in Publication EP-A-1 253 562 describes an automatic dispenser for beverages which may be packaged in metal cans or small plastic bottles with a volume of from 25 to 50 cl. The product is stored in tiered drawers, and then pushed until it falls into an elevator that takes it to the lower portion where it is manually picked up by the consumer, who has previously pivoted a trap door. This design is not well suited for voluminous, heavy products that would be damaged by falling into the elevator device, nor is it well suited for recovering voluminous, heavy products that often must be gripped with two hands.

Another example is provided in Publication DE-A-33 01 905, which describes an automatic dispenser for beverages that may be packaged in containers with a capacity of several liters. The product is stored on tiered inclined ramps which allow it to advance automatically by gravity towards an elevator platform formed of an endless belt that moves the product to a discharge ramp. This dispenser also provides for the recovery of empty containers introduced onto an inlet ramp, transported by the elevator platform, and stored on ramps inclined in the opposite direction. The storage of products on inclined ramps does not guarantee that heavy products will advance in a regular, reliable, or reproducible fashion, particularly heavy products that do not slide easily and risk becoming lodged sideways, blocking the gravitational progression of products that may become stuck, causing a malfunction in the dispensing process. Moreover, this type of storage requires that a stop be placed at the front of the inclined ramps which must be retracted to allow the product to pass toward the elevator and then repositioned to hold back the next row of products, requiring complex controls and incurring the risk of malfunctions.

Until now, there has been no device that is reliable, economical and ergonomic for dispensing large or heavy products or products sold in packs or in carboys such as, for example, mineral water, milk, or other beverages.

Furthermore, mineral water consumption is increasing, greatly because of the deterioration in tap water quality. This phenomenon can be observed more and more in large cities and geographical regions where groundwater is polluted by agricultural treatment or farming effluent. Today the sale of bottled water takes place principally on two levels: large scale distribution and HOD (Home and Office Delivery), that is, distribution of water to homes or offices in either bottles or in carboys adapted for drinking fountains, with large scale distribution being the foremost mode of distribution. Based on the average consumption of bottled water by a family, a purchase of bottled water or milk in cartons consists of from four to eight bottles or cartons and quickly becomes a chore for the consumer in terms of weight, size, and handling. In addition, after consumption, the packaging must be dealt with either as trash, which immediately becomes cumbersome, or as recycled products that require storage and then specialized transportation to a waste sorting facility.

DESCRIPTION OF THE INVENTION

The objective of the invention is to propose a new dispensing apparatus for bottled mineral water sold in packs or carboys, for example, that is simple, economical, reliable, and requires little upkeep. The invention provides a new outlet for distribution by combining: (1) the practicality of being located close to the consumer's home; (2) the ecological advantage of centralized package recycling, and (3) the opportunity for stimulating sales of bottled water.

To achieve this, the invention concerns an automatic apparatus for dispensing voluminous and/or heavy products and/or products sold in packs consisting of at least one box comprising at least one unit for storing said products structured in tiers and equipped with a means for advancing at least one product toward at least one transfer zone, a transfer means provided in the transfer zone for receiving on a flat surface the product which has been propelled by said advancing means and for transporting it from the storage unit toward at least one outlet orifice, a means for blocking said outlet orifice which, when closed, prevents access to the interior of said storage unit and when open, allows said product to exit, an anti-tampering means for preventing access to the interior of said storage unit when the blocking means is open, and a means for controlling the entire unit.

Preferably said apparatus comprises a pushing means to evacuate the product outside of said box through said outlet orifice, said blocking means comprising at least one trap door coupled with an actuation means controlled by said pushing means so as to open the trap door, allowing the product to exit, and close it after the product has exited.

Said apparatus may comprise a means for payment and/or product selection.

In a preferred embodiment of the invention, the tiers in the storage unit consist of superimposed fixed platforms, each capable of receiving at least one row of products. Each platform may support several rows of products arranged side by side and separated by guide means.

In the preferred form of the invention, the advancement means is designed to push at least one row of products. Each row of products may comprise an advancement means, or the advancement means may be common to several rows of products.

This advancement means may comprise at least one motor which is coupled, through at least one transmission, with a means for pushing the corresponding row of products.

Each fixed platform may comprise a surface for rolling and may also be slightly inclined toward the rear opposite the transfer zone.

The transfer means may comprise at least one motor coupled with a movable platform through at least one transmission in order to displace it to the interior of the transfer zone in front of the fixed platforms in the storage unit along guides integral with the box.

The movable platform may define a plane angled toward the front and it may comprise a surface for rolling.

According to a first embodiment, the fixed platforms in the storage unit comprise an inclined ramp in the front angled downward so that the product supported by said movable platform is pushed onto it when it descends, said inclined ramps growing progressively shorter from the upper platforms to the lower platforms.

According to a second embodiment, the movable platform comprises a fixed base and a plate that moves in said inclined plane, a recall device located between them, inclined ramps integral with the box and located in the trajectory of the transfer means opposite the fixed plates of the storage unit, which cooperate with said plate so as to move it close to the storage unit and facilitate removal of the product, with the inclined ramps decreasing in depth from the top to the bottom of the transfer zone.

The transfer means may comprise a plate located at the upper portion of the movable platform far enough away to allow products to be loaded between the plate and the movable platform and at least partially constituting said anti-tampering means.

In the preferred form of the embodiment, the outlet orifice is located in the lower portion of the box and it comprises a sliding base plate outside the box equipped with at least one ramp inclined toward the ground. The trap door advantageously covers at least the surface of this orifice and the actuation means comprises at least one actuator coupled with this trap door for displacing it parallel to itself between the open and closed positions.

The pushing means may comprise at least one actuator coupled with a pushing means defining at least one contact surface designed to enter into contact with said product to be evacuated. Preferably the axis of the actuator is generally parallel to the plane of the transfer means and the contact surface of said pushing means is flat and generally perpendicular to said plane.

The pushing means is advantageously designed to block the outlet orifice when the trap door is in the open position and at least partially constitutes said anti-tampering means for preventing any intrusion into the interior of the box.

The box of the dispensing machine of the invention is advantageously isothermal and it may include thermal regulation means to cool and/or heat the inside of the box depending upon the outside temperature.

In the preferred embodiment, the dispensing machine comprises a recycling container adjacent to the box and equipped with at least one inlet orifice for receiving empty product packaging. This inlet orifice may comprise an access trap movable between a closed position and an open position and coupled with an actuator controlled by the regulating means. This recycling container may also comprise a means for compacting empty packaging.

SUMMARY DESCRIPTION OF THE DRAWINGS

The present invention and its features will be more apparent from the following description of embodiments provided by way of non-limiting examples, with reference to the attached drawings, in which.

DETAILED DESCRIPTION OF THE INVENTION

Figure 1:
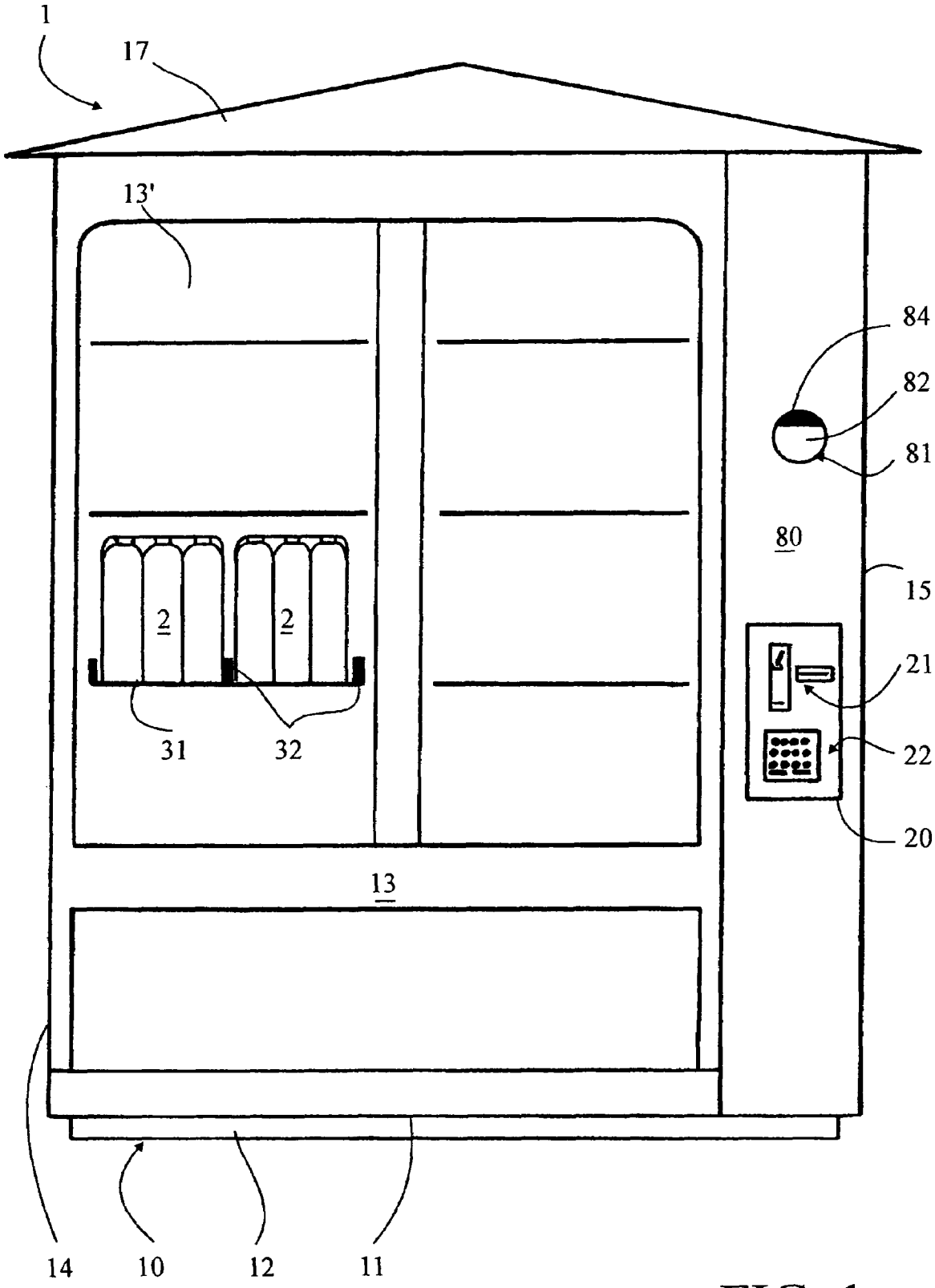
FIG. 1 is a surface view of a dispensing apparatus according to the invention.

With reference to the drawings, dispensing apparatus 1 of the invention is specifically designed to automatically dispense large and/or heavy products 2 and/or products sold in packs, such as, for example, bottles of mineral water, cartons of milk, or any other beverage sold in packs of four to eight, carboys of spring water with a 5 to 10 liter (1.32 to 2.64 gal) capacity, packages of laundry detergent or softener, etc., said apparatus being capable of offering one or more types of products, or one or more brands of products.

Said dispensing apparatus 1 consists of an exterior box 10, generally cube shaped, defining a base 11 with feet 12 resting on the floor, a front wall 13, two side walls 14 and 15, a rear wall 16 and a top 17. At least one of the walls, for example front wall 13, forms an articulated entryway with one or more swinging doors allowing access to the interior of box 10 to restock products 2 and for maintenance. Obviously the shape of box 10 and its exterior appearance could be different and selected in accordance with the environment in which dispensing apparatus 1 will be installed. Preferably, box 10 is thermally insulated to prevent overheating in the summer and freezing in the winter. It may include one or more refrigerating groups 3 and/or one or more heating groups 4 supplied through the electrical network and controlled by at least one interior temperature sensor 5. An external temperature sensor may be added if needed. Its front wall 13 may comprise a glass portion 13 through which the products for sale 2 are partially or completely visible. There may also be no glass portion but instead, a visual display (labels) to identify the products 2 for sale. It may also have a lighted banner displaying advertising slogans or other slogans. The body of dispensing apparatus 1 may also be used for advertising display.

As with the majority of such devices, this dispensing apparatus 1 comprises a payment means 21 and/or a means 22 for selecting products 2 that may be centralized, for example, in an electric control box 20. Payment means 21 may be adapted for payment by token, cash, bank card or prepaid card, which seems to be the simplest way to limit risk of theft, as the apparatus would contain no money. Selection means 22 may consist of a keyboard with selection buttons for identifying products and digital touch pads for selecting the desired number of products 2. A display screen (not shown) may be associated with electrical control box 20 to indicate the steps to be followed, the quantity of stored products available, etc. If needed, other functions such as a recycling function may be added to each of these elements 21, 22.

Figure 7:
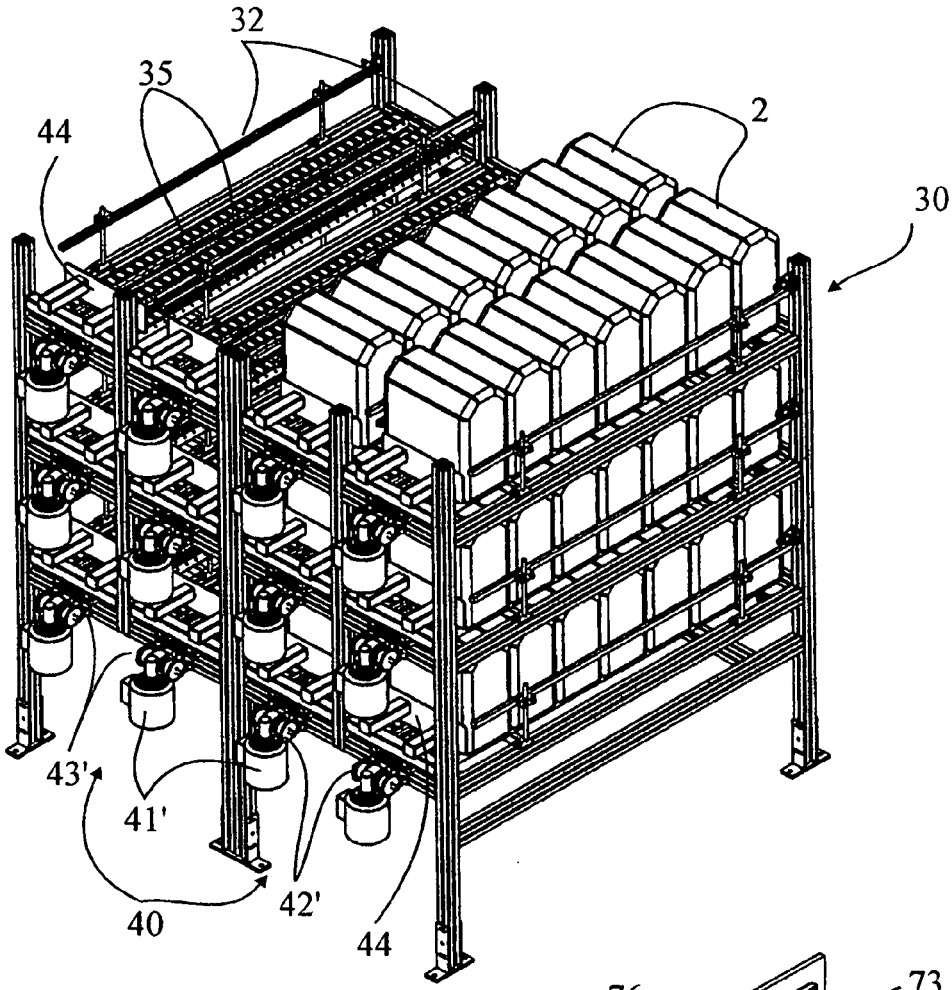
FIG. 7 is a perspective of another mode of embodiment of the storage unit of the apparatus of FIG. 1.

Box 10 defines at least one storage unit 30 for products 2 structured in tiers, each tier consisting of at least one fixed platform 31 capable of receiving one or more rows of products 2 arranged side by side. These fixed platforms 31 may consist of a surface for sliding or a surface for rolling. In the first case they may be formed of a plate that may or may not be metal and which is coated with a slippery material such as Teflon®, for example. In the second case they may consist of rollers, such as rails with wheels 35 as shown in FIG. 7. These fixed platforms 31 may be horizontal or preferably slightly inclined toward the rear to promote displacement of products 2 by their own weight, particularly during loading through the front of dispensing apparatus 1. The angle α of the slope may be minimal, approximately equal to 1°, which is sufficient for an object to slide by virtue of its own weight (cf. FIG. 9). Each fixed platform 31 is supplemented by lateral guides 32 to separate the rows of products 2 and guide them in translation, such as walls, rails, etc.

Advancement means 40 are associated with each row of products to displace it towards a transfer zone 50 located at the front of storage unit 30. A single advancement means may be provided for all the tiers, or one advancement means for each tier; they are movable and can be positioned opposite the row of products 2 selected. It is also possible to provide an advancement means 40 for each row of products 2 as in the embodiments illustrated. They comprise, with reference to FIGS. 2 and 3, a motor or reduction gear motor 41 connected to a pushing means 44 by means of an endless screw transmission 42 and a nut. Nut 43 is integral with pushing means 44 moving in translation along corresponding fixed platform 31 and designed to displace the row of products 2 by pushing them. In another embodiment shown in FIG. 7 the advancement means 40 comprises a motor or reduction gear motor 41' connected to pushing means 44 through a pinion 42' and chain 43' transmission. It is possible to employ other types of advancement means such as a cylinder or other equivalent actuator. Fixed platform 31 comprises a slot 32 allowing pushing element 44, located above, to communicate with transmission means 42, 43 or 42', 43' located below said fixed platform 31. Pushing means 44 in this case consists of a plate generally perpendicular to fixed platform 31 in order to provide a large enough flat surface for products 2 to ensure that they are displaced in parallel to one another. The plate of pushing element 44 may be connected to transmission element 42, 43 or 42', 43' by an angled portion allowing it to push the row of products all the way to the end of fixed platform 31. This advancement means 40 ensures the controlled, steady advancement of products, eliminating any risk of blocking due to malpositioning.

Figure 8:
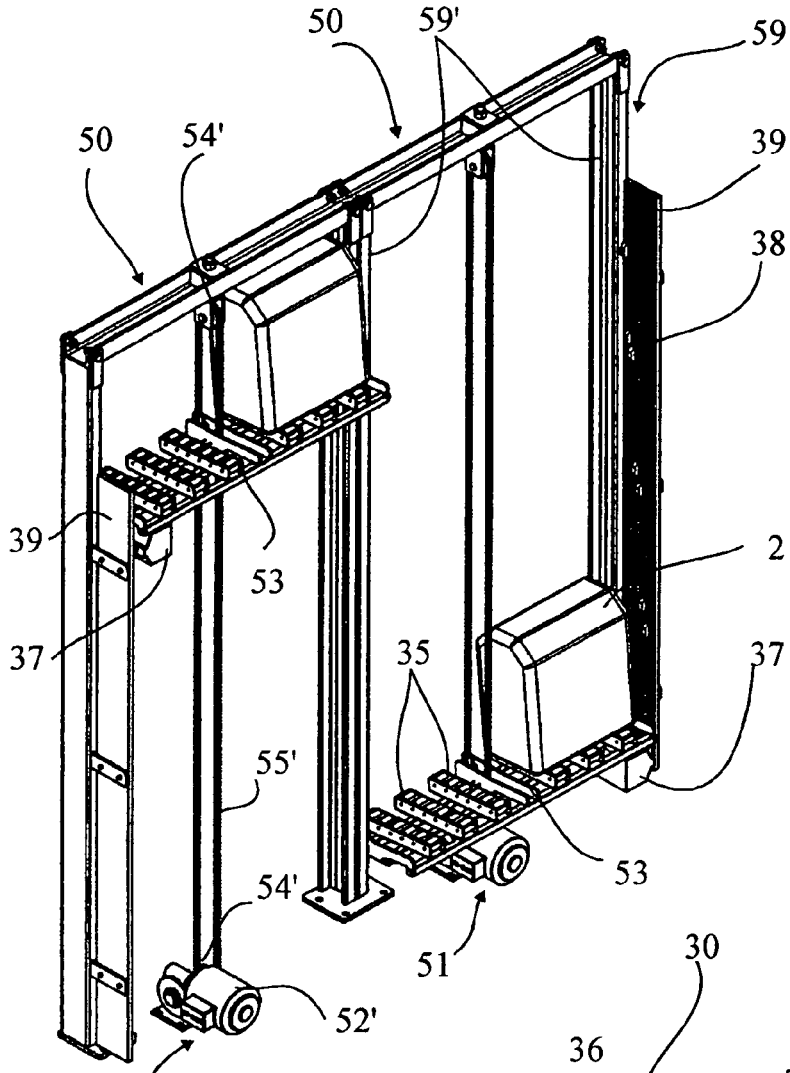
FIG. 8 is a perspective of another mode of embodiment of the transfer means of the apparatus of FIG. 1.

Transfer zone 50 comprises a transfer means 51 that moves vertically from bottom to top and vice versa to locate at least one selected product 2 from storage unit 30, separate it from the other stored products 2, and move it until it is opposite at least one outlet orifice 60 blocked by a blocking means comprising at least one trap door 61. In the example shown in FIG. 2 the transfer means 51 comprises a motor or a reduction gear motor 52 positioned on a movable platform 53, said motor 52 engaging through a pinion motor 54, a rack 55 integral with intermediate wall 18 attached to box 10 at the rear of front wall 13. This movable platform 53 is guided in vertical translation along guide columns, rails, or grooves (not shown) provided at least on either side of rack 55 in intermediate wall 18 of box 10. If needed, this transfer means 51 may comprise a second rack 55 located opposite the first one, with motor 52 being connected to two pinions 54 turning in the opposite direction and each engaging a rack 55 to strengthen the lifting force. Racks 55 may also be located on the sides of box 10 on either side of movable platform 53. In the embodiment shown in FIG. 8 the transfer means 51 is duplicated to create two distinct transfer zones 50, each having its own movable platform 53. In this example each transfer means 51 comprises a motor or a reduction gear motor 52' connected to a movable platform 53 through a pinion 54' and chain 55' transmission. Other types of transfer means 51 may also be adapted, such as for example a motor, a reduction gear motor, one or more cylinders connected to a cable and pulley transmission, or any other suitable device. This movable platform 53 is guided in vertical translation by lateral guide rails 59' forming part of a cross beam 59 attached to box 10.

Movable plates 53 may consist of a surface for sliding or a surface for rolling for the same purpose as fixed platforms 31. In the example in FIG. 8, these movable platforms 53 each form a surface for rolling obtained by using rails with wheels 35 as with the storage unit in FIG. 7. Preferably, each movable platform 53 defines a plane angled toward the front relative to the horizontal, with the upper level located on the side of storage unit 30 and the lower level on the opposite side to ensure that the selected product 2 is held firmly in place on movable platform 53, for example, sliding along intermediate wall 18 without the risk of product 2 falling or being lost. The angle β of this inclined plane may be several degrees, for example, 5° (cf. FIG. 9). This angled plane also promotes separation of the selected product 2 from the other products 2 in the same row by causing it to tilt several degrees and unstick the surfaces in contact (cf. FIGS. 5, 6, 9).

Figure 5:
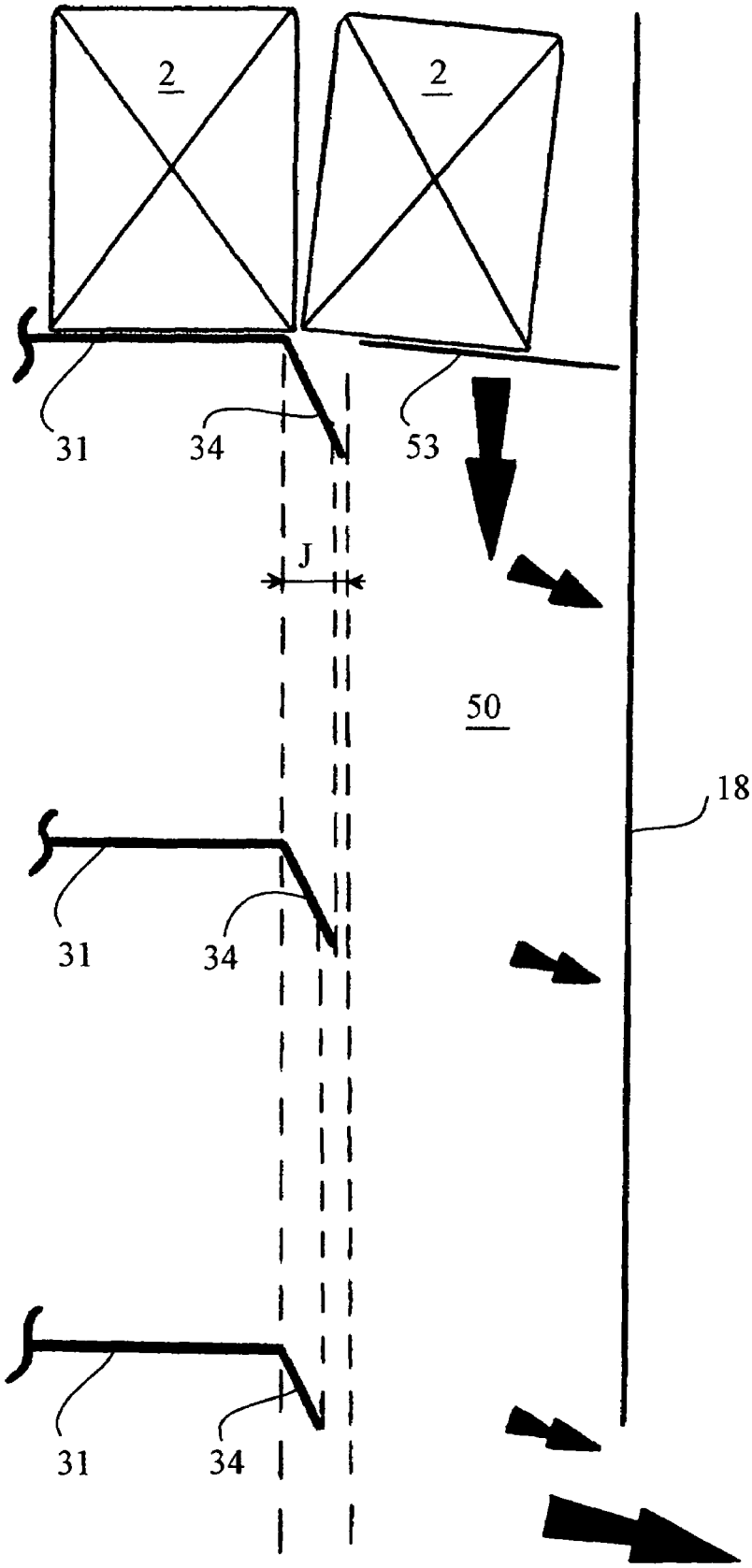
FIG. 5 is an enlarged detailed view of the transfer zone according to a first variation.
Figure 6:
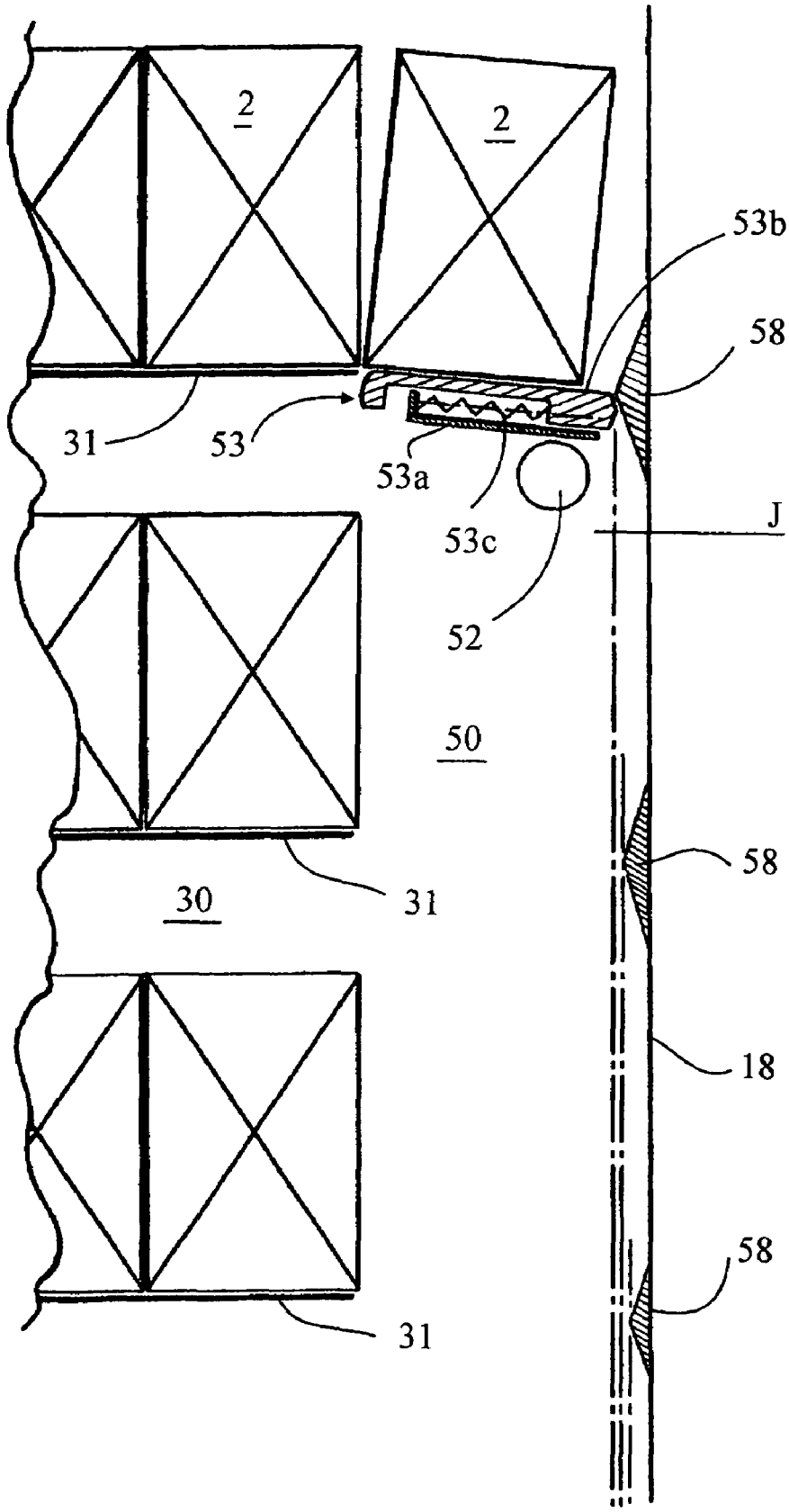
FIG. 6 is a view similar to FIG. 5 according to a second variation.

If movable platform 53 consists of a surface for sliding according to the variation illustrated in FIG. 5, fixed platforms 31 have along the edge near transfer zone 50 a downwardly inclined ramp 34 in order to push selected product 2 onto movable platform 53 when the platform is displaced downwards. This ingenious design allows selected product 2 to be correctly positioned on movable platform 53, taking into account the play J existing between the edge of this movable platform 53 and the edge of fixed platforms 31. Inclined ramps 34 may decrease in length from upper fixed platforms 31 toward lower fixed platforms 31 so as to eliminate any risk of interference with movable platform 53. Other means may also be used, as shown by FIG. 6, where movable platform 53 consists of a fixed base 53*a* and a movable plate 53*b* joined by a recall device 53*c*. Inclined ramps 58 integral with box 10, that is with a fixed intermediate wall 18 holding rack 55 on transfer means 51, are provided on the trajectory of movable platform 53 opposite fixed plates 31. Dual inclined ramps 58, by cooperating with a corresponding profile provided on movable plate 53*b*, move the plate close to fixed platforms 31 and facilitate the removal and positioning of selected product 2 onto movable platform 53. These inclined ramps 58 are designed to compensate for the play J between the edge of movable platform 53 and the edge of fixed plates 31 and they may decrease in depth from top to bottom towards transfer zone 50.

Figure 9:
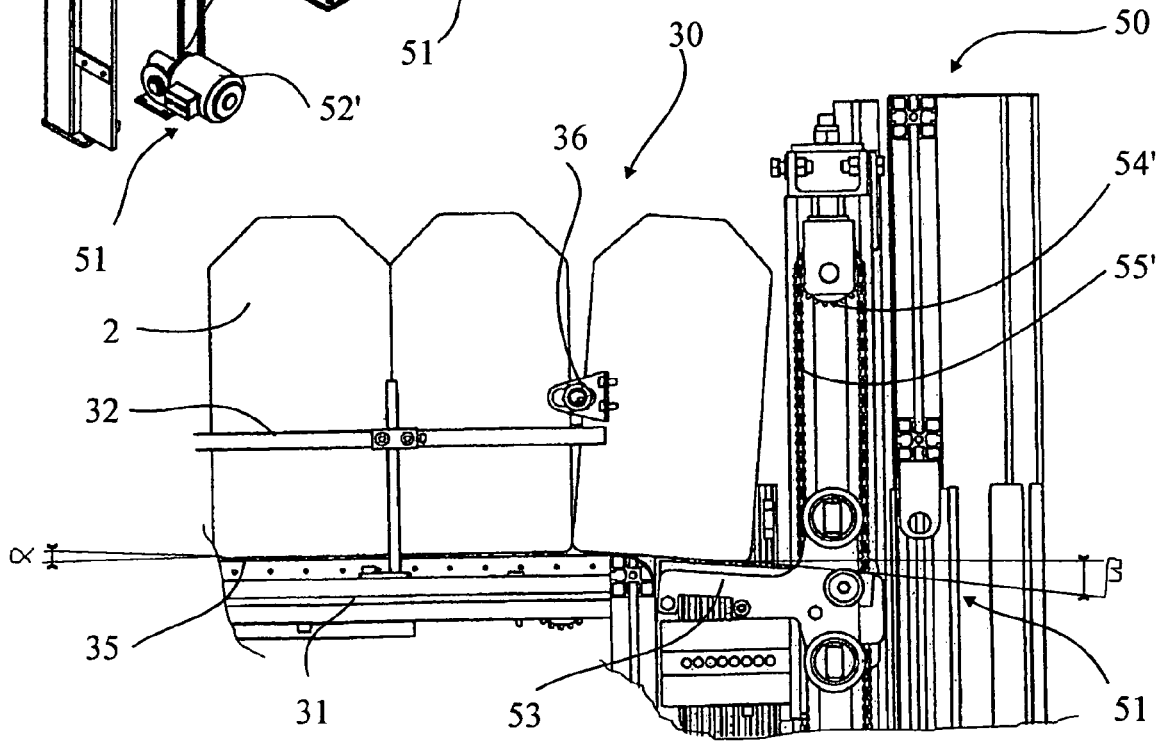
FIG. 9 is a partial side view of the storage unit and the transfer means of FIGS. 7 and 8.

Obviously it is possible to conceive of other ways to effect the separation of selected product 2 from the other stored products 2, for example, displacing movable platform 53 in lateral translation, or some other appropriate movement. In the exemplary embodiment shown in FIG. 9, products 2 are separated automatically by displacing selected product 2 by virtue of its own weight along rails with rollers 35 on movable platform 53. This solution has the advantage of being very simple to achieve. FIG. 9 also illustrates the respective angles of inclination α and β of fixed platform 31 and movable platform 53, which are reversed.

Figure 2:
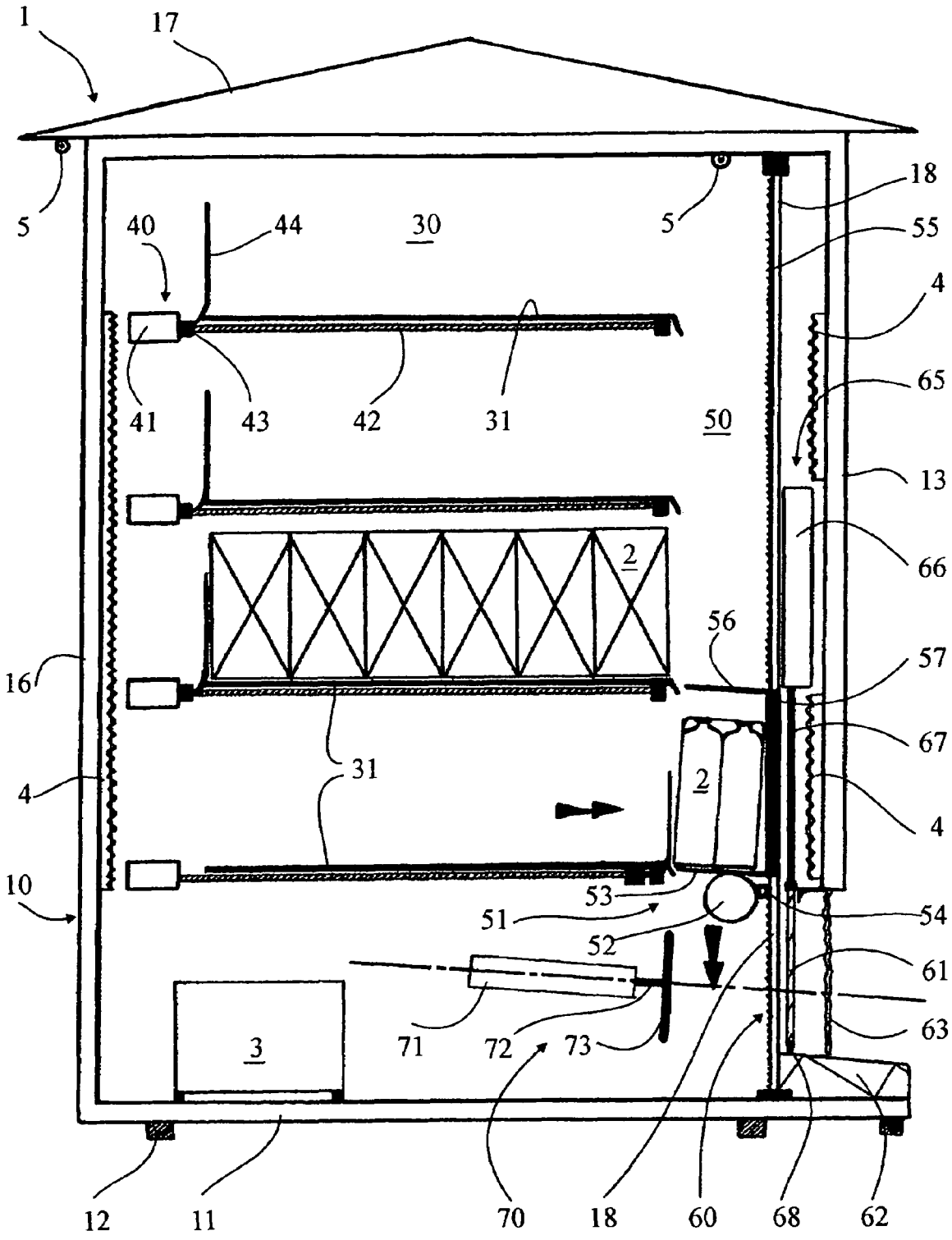
FIG. 2 is a side cross-section of the apparatus of FIG. 1.
Figure 3:
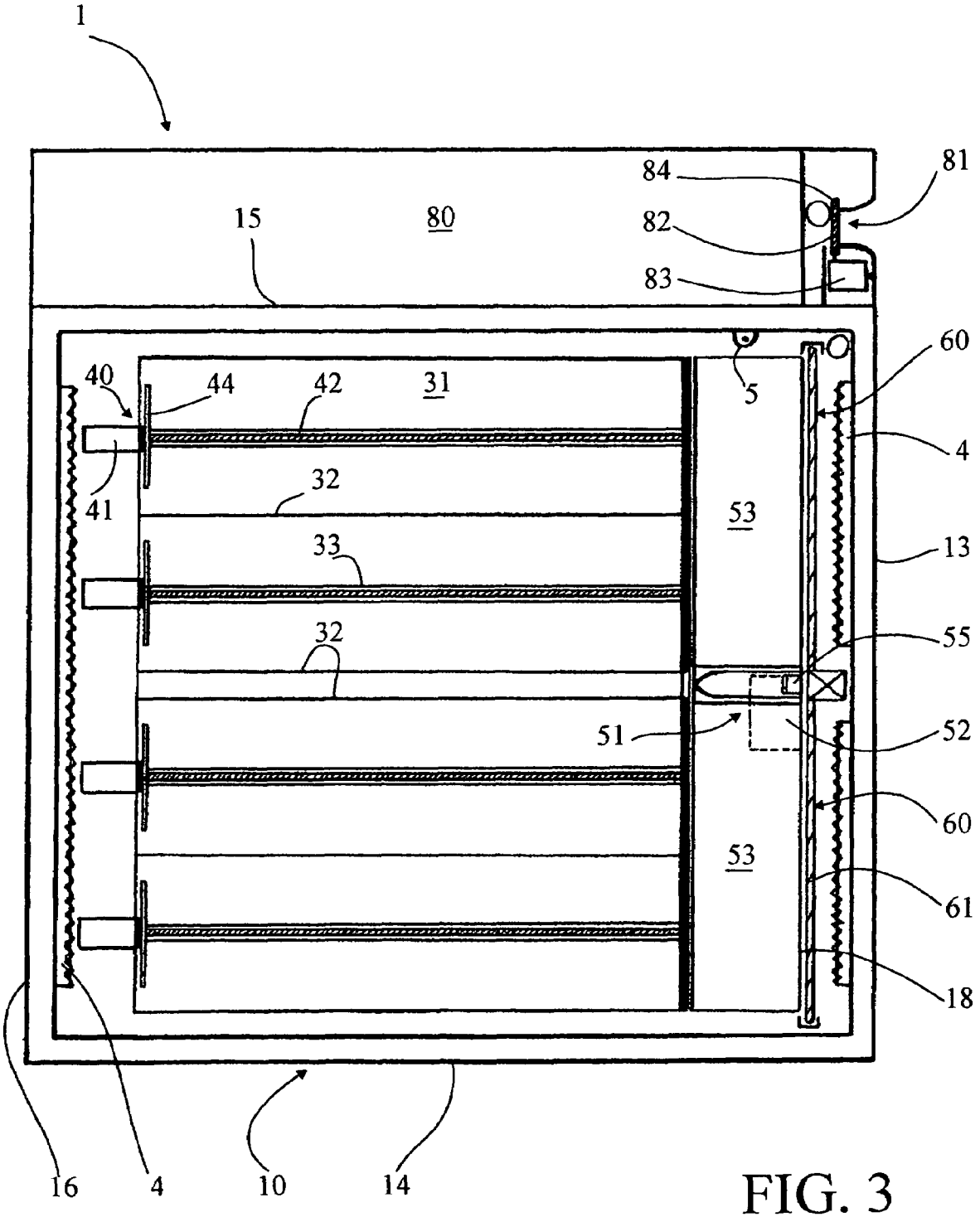
FIG. 3 is an overhead cross-section of the apparatus of FIG. 1 at the level of the storage area.

With reference to FIG. 2 movable platform 53 includes an anti-vandalism plate 56 at the upper portion connected to movable platform 52 by elements 57, with the unit forming an open elevator. The space between movable platform 52 and anti-vandalism plate 56 is large enough to permit loading of products 2. The function of this anti-vandalism plate 56 is to block access to storage unit 30 and transfer zone 50 at the moment selected product 2 is evacuated through outlet orifice 60.

In the example shown outlet orifice 60 is located in the lower portion of box 10 and opens onto a sliding plate 62 outside box 10. This sliding plate 62 may comprise a plane that is angled toward the floor so selected product 2 descends by gravity, and it may either be extended along a horizontal plane or slightly raised to prevent product 2 from falling. In other configurations it is possible for outlet orifice 60 to be located at a different level, in the center or the upper portion. The advantage of having it at the bottom is that it is easier for the consumer to grip purchased product 2 due to its weight and its volume. Actually, selected product 2 is evacuated onto sliding plate 62 which is slightly raised from the floor so the purchaser can seize the pack can by its handle, almost without bending down. In addition, the positioning of outlet orifice 60 at the lower portion allows dispensing apparatus 1 to commence another dispensing cycle even if product 2 selected in the preceding cycle remains on sliding plate 62. In this case, product 2 selected by the cycle in progress would push out the previous product if necessary, which would tip to the floor without being damaged.

Trap door 61 is hidden by a flexible exterior protector 63, for example, rubber strips or the like. It is controlled by an actuation means 65 comprising an actuator 66 such as a cylinder housed between transfer zone 50 and front wall 13. The shaft 67 of said actuator 66 is connected to trap door 61 to displace it in its plane and retract it, freeing outlet orifice 60 during evacuation of the product select. Other actuation means 65 may be provided and there may be more than one outlet orifice 60 and trap door 61 depending on the size and design of dispensing apparatus 1. Trap door 61 preferably is made of a specific tamper-proof material. It may have seals 68 added to it, such as sealing rubber lips, to weatherproof the interior space of box 10. It may further comprise, depending upon the regulations in force, an anti-grip and anti-crush safeguard in the form of a flexible spring in the lower portion that stops the descent of trap door 61 if there is an obstacle. The function of this trap door 61 is to prevent access to the interior of box 10 and eliminate any attempted vandalism. It only opens to allow evacuation of selected product 2 and it closes immediately upon evacuation.

Figure 4:
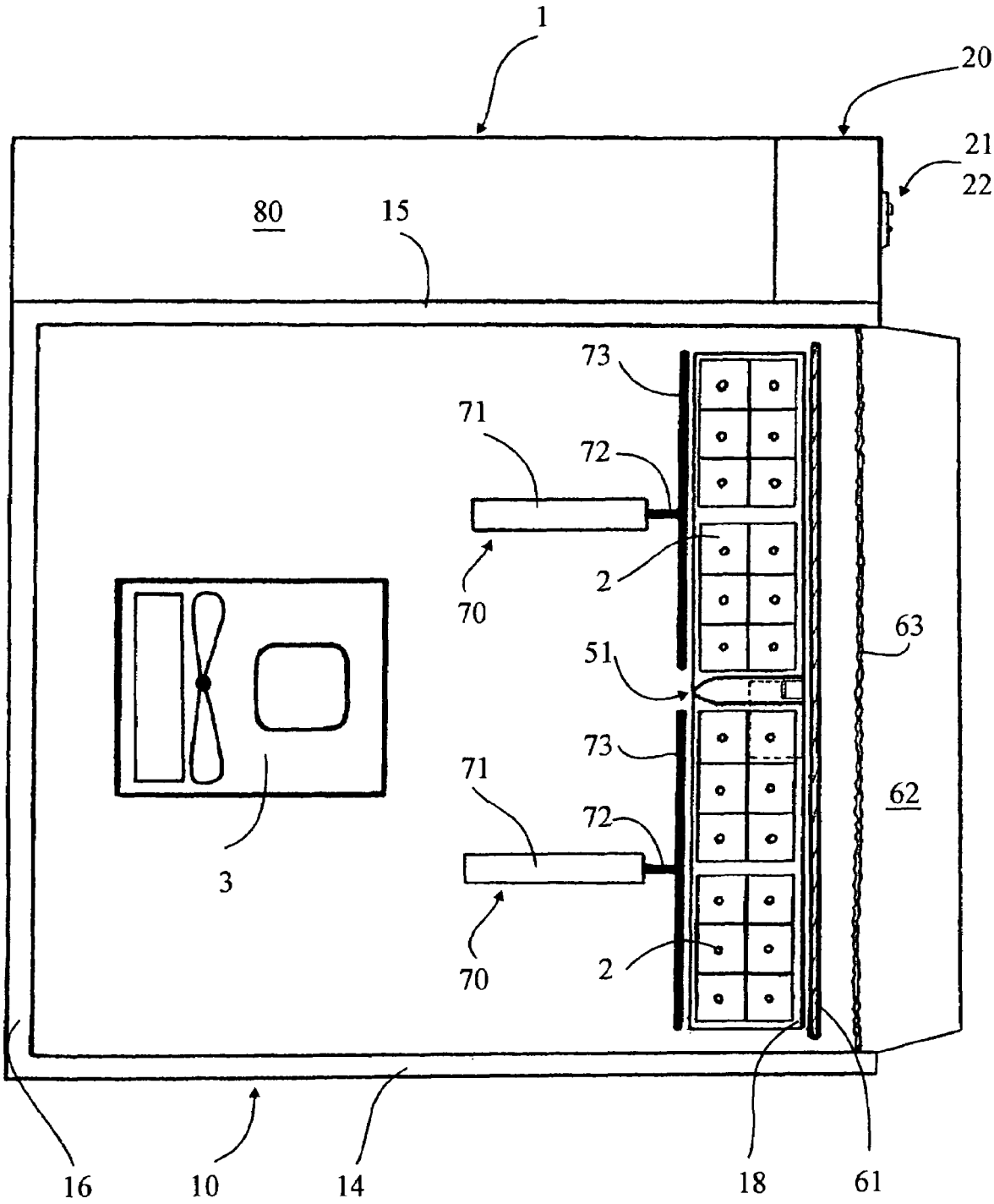
FIG. 4 is an overhead cross-section of the apparatus of FIG. 1 at the level of the outlet orifice.
Figure 10:
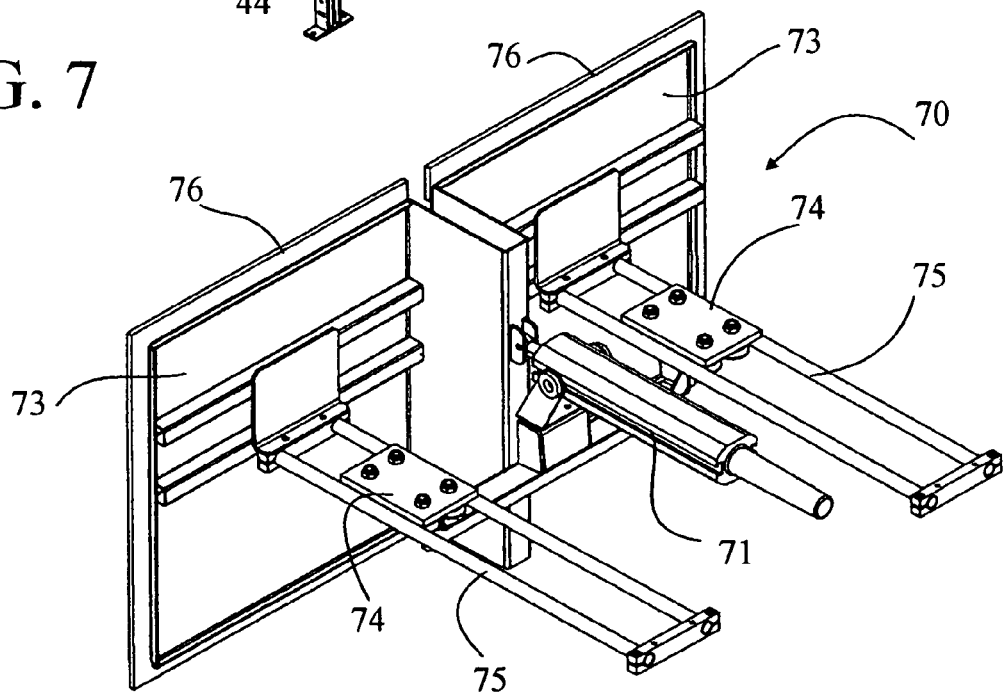
FIG. 10 is a perspective of another mode of embodiment of the pushing means of the apparatus of FIG. 1.

A thrusting means 70 is located at the rear of outlet orifice 60 to evacuate the product selected out of box 10 through this outlet orifice 60 and move it to sliding plate 62. It consists of at least one cylinder 71, the shaft 72 of which is connected to a pushing element 73. To optimize this force, the axis of cylinder 71 is generally parallel to the inclined plane of movable platform 53 and pushing means 73 presents to selected product 2, a flat contact surface generally perpendicular to this inclined plane. In the example shown in FIG. 4, thrusting means 70 comprises two cylinders 71 and two pushing elements 73 distributed on either side of rack 55 and operating independently to evacuate selected product 2 originating from either the right or the left of storage unit 30. In the example shown in FIG. 10 thrusting means 70 comprises a central cylinder 71 connected to two pushing elements 73 by two carriages 74 on rollers moving along movable slides 75. Thus, the two thrusting elements 73 are activated if either one or two products 2 are selected. In this example the dimensions of each thrusting element 73 are slightly smaller than those of corresponding outlet orifice 60 and a sealing lip 76, for example a rubber seal, is provided on the periphery to seal this outlet orifice 60 while selected product 2 is exiting, without any risk of crushing it. This system also offers the advantage of protecting dispensing apparatus 1 from theft and vandalism when trap door 61 is open, given that thrusting device 73 and its seal 76 totally block outlet orifice 60 and prevent access to the interior of box 10. Therefore, it offers another solution to anti-vandalism plate 56 provided on movable platform 53 in the example of FIG. 2. The cylinders 66, 71 that are used are advantageously electric cylinders, as they are not affected by freezing.

Distribution apparatus 1 such as the one illustrated with reference to FIGS. 1 through 4 also has a recycling container 80 attached to box 10, either on the side or at the top, to collect empty packaging from products 2 and offer the consumer a centralized location to purchase products 2 for consumption and return products 2 after consumption. Said recycling container 80 comprises at least one inlet orifice 81 sized to accept these empty packages. Said inlet orifice 81 is at least partially blocked by an access trap door 82 movable between a closed position and an open position. The opening of this access trap door 82 may be automatic and associated with the purchase of products 2 for consumption, thereby eliminating unwanted deposits into recycling container 80. In this case, access trap door 82 is controlled by an actuator 83 which may be a motor, a cylinder, or any other appropriate device. If access trap door 82 only partially blocks this inlet orifice 81, then the remaining portion may comprise a flexible rubber skirt 84, for example, to eliminate the risk of pinching one's hand while introducing an empty package inside if access trap door 82 closes. This recycling container 80 may also comprise a means for compacting empty packaging (not shown), increasing its storage capacity relative to the space it occupies. Finally, it comprises a front, rear or side access door for emptying it at regular intervals or when a sensor (not shown) indicates that threshold capacity has been reached. For this purpose recycling container 80 may be provided with a plastic bag or a removable container to facilitate the recovery of empty packaging.

Control elements (not shown), preferably automatic, associated with sensors, course limit detectors, detectors, etc., are provided to monitor the entire dispensing apparatus 1 autonomously and securely. The various actuators 41, 41', 52, 52', 66, 71, 83 are controlled according to the means of payment and/or selection of products 2 and according to a predefined operating cycle. For example, course limit detectors (not shown) are provided at each extremity of each fixed platform 31 to control the end positions of advancement means 40. A presence sensor 36 (cf. FIG. 9) makes it possible to regulate the advance of products 2 and inventory them to determine the amount of stored product 2 remaining on each fixed platform 31. A multiposition sensor 37 affixed to each movable platform 53 (cf. FIG. 8) ensures that it is precisely positioned relative to fixed platforms 31 using magnetic cams 38 located on a lateral rail 39 integral with cross beam 59. There may be two cams 38 on each stage of storage unit 30, one to slow down transfer means 51 and the other to stop them. Two other cams located at the extremities control the end positions of the transfer means 51. The end positions of trap door 61 and thrusting means 70 are also controlled by course limit detectors. It is apparent that other types of sensors or even other methods could be adapted, such as electronic cards controlling self-regulating motors. The control means could also be connected to a computer through a telephone line or other means of communication for viewing the location of dispensing apparatuses 1, regulating the supply of products 2, emptying recycling container 80, maintenance, etc.

POSSIBILITIES FOR INDUSTRIAL APPLICATION

The operation of such a dispensing apparatus 1, with reference to FIGS. 1 through 4, is simple and accessible to everyone. One of these modes of operation is described below by way of non-limiting example. For example, the consumer introduces a prepaid card into the slot of the electric box 20 controlling means of payment 21 and on the selection keyboard 22, selects the product or products 2 to be purchased. If he or she also wishes to recycle empty packaging, the appropriate "recycling" touchpad is selected, as well as the number of packages to be recycled. Either simultaneously with the dispensing cycle for the selected products 2 or later, the recycling command is given to actuator 83 which opens access trap door 82 on recycling container 80 until the number of packages to be recycled is reached. As for the dispensing cycle, the transfer means 51 is activated to move movable platform 53 opposite one of the shelves in storage unit 30 where the first selected product 2 is located. Next the advancement means 40 corresponding to the row of products 2 concerned is activated to push this row for a distance equal to the length of product 2, and the product 2 at the end of the row is then transferred to movable platform 53 by sliding or rolling onto it. At this moment transfer means 51 is activated to lower movable platform 53 opposite outlet orifice 60. When its position is detected, actuation means 65 and thrusting means 70 are activated to first, lift trap door 61 and open outlet orifice 60, and second, extend rod 72 from cylinder 71 and push selected product 2 to the outside of box 10. While selected product 2 is exiting, access to storage unit 30 and transfer zone 50 is blocked by anti-vandalism plate 56 located in the transfer means 51 or by the action of pushing element 73 itself (cf. FIG. 10). When the selected product 2 exits, thrusting means 70 and actuating means 65 are reactivated in the opposite direction or released to return to their initial position by a recall means which first replaces rod 72 inside cylinder 71, and then lowers trap door 61 and closes outlet orifice 60. Actuation means 65 may be directed by pushing means 70 to close trap door 61 when pushing element 73 has cleared outlet orifice 60 to prevent objects or people from intruding into box 10 and causing harm to dispensing apparatus 1. Another dispensing cycle can then begin. Depending upon the products 2 selected, transfer means 51 can be programmed to search for several products 2 on different tiers or in different rows inside storage unit 30 in order to deliver them simultaneously or successively through outlet orifice 60.

This dispensing apparatus 1 offers consumers a new distribution network for voluminous, heavy, widely consumed products such as, for example, bottled water, cartons of milk, or any other product. It is simple, reliable, ergonomic, close to home, low cost, and eliminates the burden of carrying heavy packages during weekly shopping trips. It would actually be easy to install this dispensing apparatus 1 in the center of housing developments, in large buildings, on the perimeter of neighborhood access roads, in village squares, etc. Combined with a recycling container 80 for empty packaging, this dispensing apparatus also offers consumers a conveniently located ecological benefit by associating the operation of recycling empty packages with the operation of purchasing new products. In addition, the advantages and the services offered by this new distribution network can stimulate and develop product sales, publicize new product brands, promote one or more brands, etc., as dispensing apparatus 1 can be dedicated to either a single product or a variety of products.

The present invention is not limited to the exemplary embodiments described, but extends to any modification and variation obvious to a person skilled in the art while still remaining within the scope of protection defined by the attached claims.

The invention claimed is:

1. An apparatus (1) for automatically dispensing products (2) that are at least one of voluminous, heavy and sold in packs, the apparatus comprising of at least one box (10) comprising at least one storage unit (30) for the products (2) comprising platforms superimposed in tiers and a means (40) for advancing at least one of the product (2) to at least one transfer zone (50), a transfer means (51) provided in the transfer zone (50) for receiving on a contacting plane the product (2) pushed by an advancement means (40) and transporting the product (2) from the storage unit (30) to at least one outlet orifice (60), a pushing means (70) for evacuating the product (2) outside the box (10) through the outlet orifice (60), a blocking means (61) for blocking the outlet orifice (60) so as, when in a closed position, to prevent access to an interior of the storage unit (30), and, when in an open position, to allow the product (2) to exit, an anti-tampering means (56, 73) for preventing access to the interior of the storage unit (30) when the blocking means (61) is in the open position, and a means for monitoring the unit;

the tiers in the storage unit (30) comprise fixed platforms (31) each capable of receiving at least one row of the products (2); and a movable platform (53) comprise a fixed base (53*a*) and a movable plate (53*b*), with a recall device (53*c*) disposed between the movable platform (53) and the movable plate (53*b*), and inclined ramps (58) integral with the box (10) and located on the trajectory of the transfer means (51) opposite the fixed platforms (31) in the storage unit (30) cooperate with the movable plate (53*b*) by moving the movable plate (53*b*) closer to the storage unit (30) to facilitate removal of the product (2).

2. The dispensing apparatus according to claim 1, wherein the blocking means comprises at least one trap door (61) connected to an actuation means (65), controlled by the pushing means (70), so as to open the trap door (61) in order to allow the product (2) to exit and close the trap door (61) once the product has exited.

3. The dispensing apparatus according to claim 1, wherein the dispensing apparatus comprises at least one of a payment means (21) and a selection means (22) for at least one of the products (2) contained within the dispensing apparatus (1).

4. The dispensing apparatus according to claim 1, wherein each fixed platform (31) holds several rows of products (2) arranged side by side and separated by guide means (32).

5. The dispensing apparatus according to claim 1, wherein the advancement means (40) pushes at least one row of products (2).

6. The dispensing apparatus according to claim 5, wherein each row of product (2) comprises an advancement means (40).

7. The dispensing apparatus according to claim 5, wherein the advancement means are common to several rows of products (2).

8. The dispensing apparatus according to claim 5, wherein the advancement means (40) comprises at least one motor (41, 41') connected via at least one transmission (42, 43, 42' 43') to a pushing means (44) for pushing a corresponding row of the products (2).

9. The dispensing apparatus according to claim 1, wherein each fixed platform (31) comprises a surface for rolling.

10. The dispensing apparatus according to claim 1, wherein each fixed platform (31) is slightly inclined toward a rear end the transfer zone (50).

11. The dispensing apparatus according to claim 1, wherein the transfer means (51) comprises at least one motor (52) connected to the movable platform (53) via at least one transmission (54, 55, 54' 55') in order to displace the movable platform (53) to the inside of the transfer zone (50) in front of the fixed platforms (31) of the storage unit (30) along guides integral with the box (10).

12. The dispensing apparatus according to claim 8, wherein the transmission is selected from the group comprising at least a rack and pinion, an endless screw and bolt, a chain and pinion and a belt and pulley system.

13. The dispensing apparatus according to claim 11, wherein the movable platform (53) defines a plane inclined toward a front facilitating separation of the product (2) pushed by the advancement means (40) from a row of remaining products.

14. The dispensing apparatus according to claim 11, wherein the movable platform (53) comprising a surface for rolling.

15. The dispensing apparatus according to claim 1, wherein the fixed platforms (31) in the storage unit (30) comprise, in front, a downwardly inclined ramp (34) for pushing the product (2) held by the movable platform (53) onto the platform when it is displaced downward.

16. The dispensing apparatus according to claim 15, wherein the inclined ramps (34) decrease in length from an upper platform towards a lower platform.

17. The dispensing apparatus according to claim 11, wherein the transfer means (51) comprises a plate (56) located in an upper portion of the movable platform (63), at a sufficient distance to allow the product (2) to be loaded between the plate and the movable platform (53) and at least partially constituting the anti-tampering means.

18. The dispensing apparatus according to claim 1, wherein the outlet orifice (60) is located in a lower portion of the box (10) and the outlet orifice (60) comprises a sliding platform (62) outside the box (10) equipped with at least one ramp inclined towards a floor.

19. The dispensing apparatus according to claim 2, wherein the trap door (61) covers at least the surface of the outlet orifice (60) and the actuation means (65) comprises at least one actuator (66) connected to the trap door (61) for displacing the trap door (61) parallel to itself between the open and closed positions.

20. The dispensing apparatus according to claim 2, wherein the pushing means (70) comprises at least one actuator (71) connected to a pushing device (73) defining at least one contact surface for contacting the product (2) to be discharged.

21. The dispensing apparatus according to claim 13, wherein an axis of the actuator (71) is generally parallel to the plane of the transfer means (51) and the contact surface of the pushing device (73) is flat and extends generally perpendicular to the plane.

22. The dispensing apparatus according to claim 20, wherein the pushing device (73) blocks the outlet orifice (60), when the trap door (61) is in the open position, and constitutes at least part of the anti-tampering means.

23. The dispensing apparatus according to claim 1, wherein the dispensing apparatus comprises a recycling container (80) adjacent to the box (10) equipped with at least one inlet orifice (61) for receiving empty packaging from the products (2).

24. The dispensing apparatus according to claim 23, wherein the inlet orifice (81) comprises a trap door access (82) that moves between a closed position and an open position.

25. The dispensing apparatus according to claim 24, wherein the trap door access (82) is connected to an actuator (83) controlled by the regulating means.

26. The dispensing apparatus according to claim 23, wherein the recycling container (80) comprises means for compacting the empty packaging.

27. An apparatus (1) for automatically dispensing products (2) that are at least one of voluminous, heavy and sold in packs, the apparatus comprising of at least one box (10) comprising at least one storage unit (30) for the products (2) comprising platforms superimposed in tiers and a means (40) for advancing at least one of the product (2) to at least one transfer zone (50), a transfer means (51) provided in the transfer zone (50) for receiving on a contacting plane the product (2) gushed by an advancement means (40) and transporting the product (2) from the storage unit (30) to at least one outlet orifice (60), a pushing means (70) for evacuating the product (2) outside the box (10) through the outlet orifice (60), a blocking means (61) for blocking the outlet orifice (60) so as, when in a closed position, to prevent access to an interior of the storage unit (30), and, when in an open position, to allow the product (2) to exit, an anti-tampering means (56, 73) for preventing access to the interior of the storage unit (30) when the blocking means (61) is in the open position, and a means for monitoring the unit;

the tiers in the storage unit (30) comprise fixed platforms (31) each capable of receiving at least one row of the products (2);

the movable platform (53) comprise a fixed base (53*a*) and a movable plate (53*b*), with a recall device (53*c*) disposed between the movable platform (53) and the movable plate (53*b*), and inclined ramps (58) integral with the box (10) and located on the trajectory of the transfer means (51) opposite the fixed platforms (31) in the storage unit (30) cooperate with the movable plate (53*b*) by moving the movable plate (53*b*) closer to the storage unit (30) to facilitate removal of the product (2); and the inclined ramps (58) decrease in depth from a top to a bottom of the transfer zone (50).

28. An apparatus (1) for automatically dispensing products (2) that are at least one of voluminous, heavy and sold in packs, the apparatus comprising of at least one box (10) comprising at least one storage unit (30) for the products (2) comprising platforms superimposed in tiers and a mechanism (40) for advancing at least one of the product (2) to at least one transfer zone (50), a transfer mechanism (51) provided in the transfer zone (50) for receiving on a contacting plane the product (2) pushed by an advancement mechanism (40) and transporting the product (2) from the storage unit (30) to at least one outlet orifice (60), a pushing mechanism (70) for evacuating the product (2) outside the box (10) through the outlet orifice (60), a blocking mechanism (61) for blocking the outlet orifice (60) so as, when in a closed position, to prevent access to an interior of the storage unit (30), and, when in an open position, to allow the product (2) to exit, an anti-tampering mechanism (56, 73) for preventing access to the interior of the storage unit (30) when the blocking mechanism (61) is in the open position, and a mechanism for monitoring the unit;

the tiers in the storage unit (30) comprise fixed platforms (31) each capable of receiving at least one row of the products (2); and a movable platform (53) comprise a fixed base (53*a*) and a movable plate (53*b*), with a recall device (53*c*) disposed between the movable platform (53) and the movable plate (53*b*), and inclined ramps (58) integral with the box (10) and located on the trajectory of the transfer mechanism (51) opposite the fixed platforms (31) in the storage unit (30) cooperate with the movable plate (53*b*) by moving the movable plate (53*b*) closer to the storage unit (30) to facilitate removal of the product (2).

* * * * *